United States Patent [19]

Östbo

[11] 4,285,397

[45] Aug. 25, 1981

[54] HEAT-EXCHANGERS WITH PLATE-LIKE HEAT EXCHANGE ELEMENTS

[76] Inventor: John D. B. Östbo, Byvägen 84-86,, 151 52 Södertälje, Sweden

[21] Appl. No.: 84,962

[22] Filed: Oct. 15, 1979

Related U.S. Application Data

[63] Continuation of Ser. No. 756,156, Jan. 3, 1977, abandoned.

[30] Foreign Application Priority Data

Jan. 22, 1976 [SE] Sweden ..... 7600671
Dec. 29, 1976 [SE] Sweden ..... 7614704

[51] Int. Cl.[3] ..... F28D 9/02; F28F 3/12

[52] U.S. Cl. ..... 165/163; 165/167; 165/170; 165/171; 165/183

[58] Field of Search ..... 165/163-167, 165/170-171, 173, 175, 151-152, 183, DIG. 11

[56] References Cited

U.S. PATENT DOCUMENTS

| | | | |
|---|---|---|---|
| 1,286,433 | 12/1918 | Singer | 165/170 |
| 1,731,575 | 10/1929 | Hyde | 165/130 |
| 3,012,758 | 12/1961 | Lyon, Jr. | 165/153 |
| 3,033,536 | 5/1962 | Guszmann | 165/DIG. 11 |
| 3,046,758 | 7/1962 | Heuer et al. | 165/170 |
| 3,229,766 | 1/1966 | Keith | 165/170 |
| 3,273,637 | 9/1966 | Pauls | 165/171 |
| 3,308,879 | 3/1967 | Maddocks | 165/167 |
| 3,380,518 | 4/1968 | Canteloube et al. | 165/171 |
| 3,650,321 | 3/1972 | Kaltz | 165/175 |
| 4,019,572 | 4/1977 | Harlan et al. | 165/130 |

*Primary Examiner*—Sheldon J. Richter
*Attorney, Agent, or Firm*—Pollock, Vande Sande & Priddy

[57] ABSTRACT

A heat-exchanger element of the type consisting of two sandwiched metal sheets, deformed so as to define between themselves a flow channel, has a number of apertures in the portion of the element not deformed. The one heat-exchanging fluid passes through the channel and the other through the apertures, generally in a direction perpendicular to the sandwich interface. In a preferred embodiment the apertures are formed by a punching operation in the way that tongue-like flaps are formed which affect the direction of flow, create turbulence and may serve as means spacing or supporting adjacent elements.

12 Claims, 8 Drawing Figures

HEAT-EXCHANGERS WITH PLATE-LIKE HEAT EXCHANGE ELEMENTS

This is a continuation of application Ser. No. 756,156, filed Jan. 3, 1977, now abandoned.

The present invention relates to the type of heat-exchanger comprising a plurality of elements, arranged in a row adjacent each other. One of the two fluids between which a heat-exchange shall take place flows inside the elements, whereas the other fluid passes externally of the elements. Each element is composed by two metal sheets which are identical in contour and by a pressing operation or the like have been provided with bulges. The two sheets are mounted in contact with each other with the convex walls of their bulges facing outwardly. These deformed portions of the sheets define between themselves a flow channel for the first-mentioned fluid. The portions of the sheets not deformed during the pressing operation are in surface contact with each other and sealingly interconnected. Those portions form flanges integral with the flow channels and thereby effectively increasing the heat-exchanging area of the elements.

The main object of the invention is to provide a heat-exchanger of the type above specified in which the fluid located in the space defined between the jacket of the heat-exchanger and the elements can flow through the heat-exchanger perpendicular to the planes of the disc-like elements. According to the main characteristic of the invention such a flow pattern has been realized in the way that those portions of the metal sheets which form the above-mentioned flanges exhibit apertures for the passage of the external fluid.

Another object of the invention is to provide a heat exchanger comprising an array of heat exchanger elements with passageways formed in bulges in the element walls, coupling means for connecting a first passageway in a first of said elements with a second passageway in a second of said elements, and flow means for providing a flow passage through said array of heat exchanger elements. The invention provides an improvement in such heat exchangers characterized in that the flow means comprises apertures extending transversely through each of a plurality of said heat exchanger elements. Each of said transverse apertures defines a transverse flow passage through the wall of the respective heat exchanger element. Said array may comprise a plurality of said heat exchanger elements stacked one on top of another. When said apertures are formed by a punching and bending operation, forming flaps bent outwards from the elements, said flaps can improve the heat transfer capabilities of the elements or act as spacers or mechanical supports resting against one or more adjacent elements.

Still another object of the invention is to provide heat exchanger assemblies comprising heat exchanger elements with internal passages in which the passages in adjoining elements can be interconnected by coupling members integral with the respective elements. When such coupling members are located inside the contours of the heat exchange element, the latter may be closely surrounded by a jacket, whereby the heat exchanger can be more compact and the flow of the external fluid can be more readily controlled.

Further objects of the invention are to reduce the manufacturing costs of the heat-exchanger and to improve its operational properties. How those and additional advantages are realized will appear from the following detailed description of some embodiments which refers to the accompanying drawing, in which.

Figure 3:
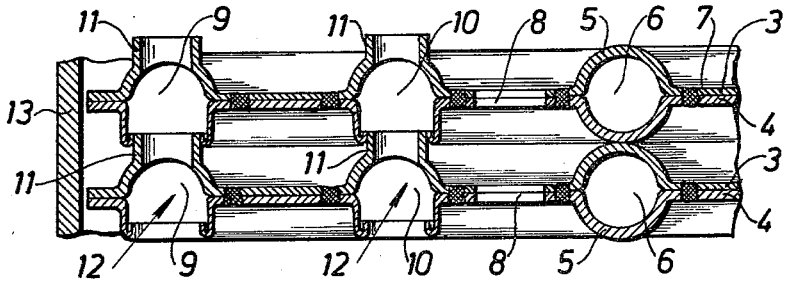
Figure 4:
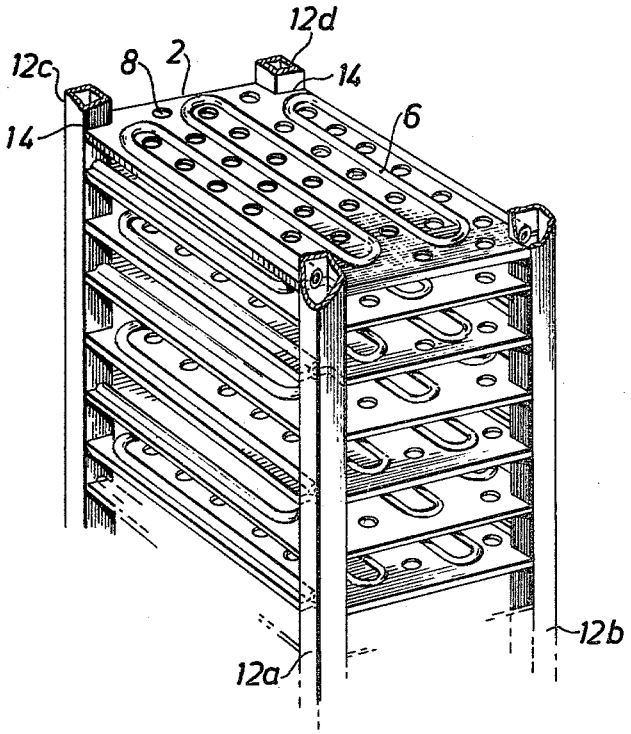
Figure 5:
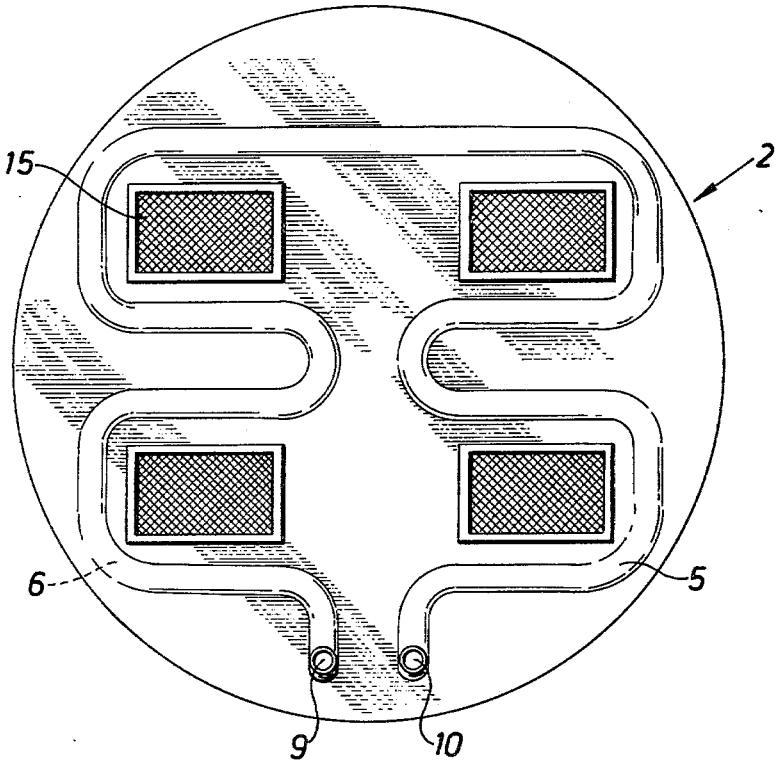
Figure 6:
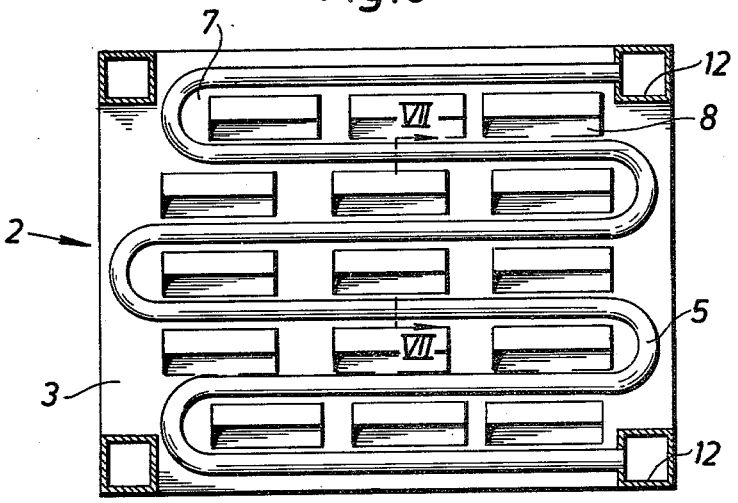
Figure 7:
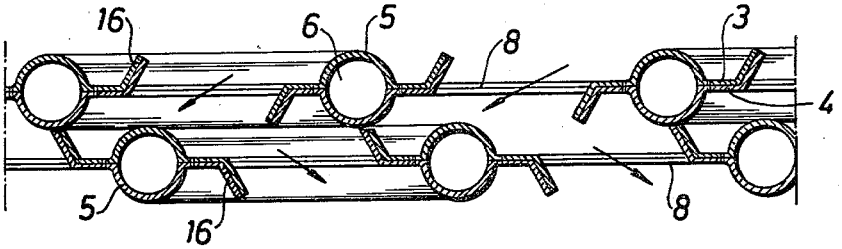

FIG. 3 does, on an enlarged scale, show an axial section through parts of two adjacent elements designed according to a second embodiment;

FIG. 4 is a perspective view showing an element assembly comprising rectangular element discs;

FIG. 5 is a horizontal view showing an element according to a third embodiment;

FIG. 6 is a horizontal view showing an element according to a fourth embodiment;

FIG. 7 is a section taken along the line VII—VII in FIG. 6; and

Figure 8:
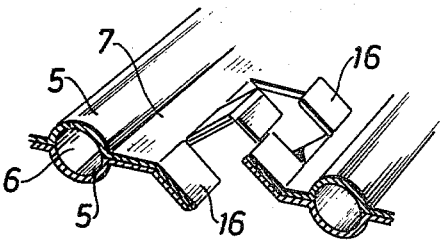

FIG. 8 is a perspective view showing a portion of an element according to a fifth embodiment.

Figure 1:
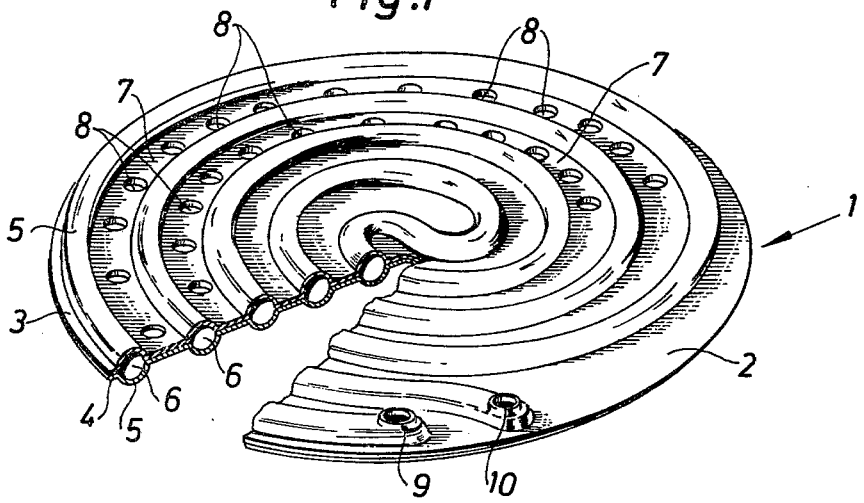
FIG. 1 is a perspective view showing a heat-exchanger element according to a first embodiment.
Figure 2:
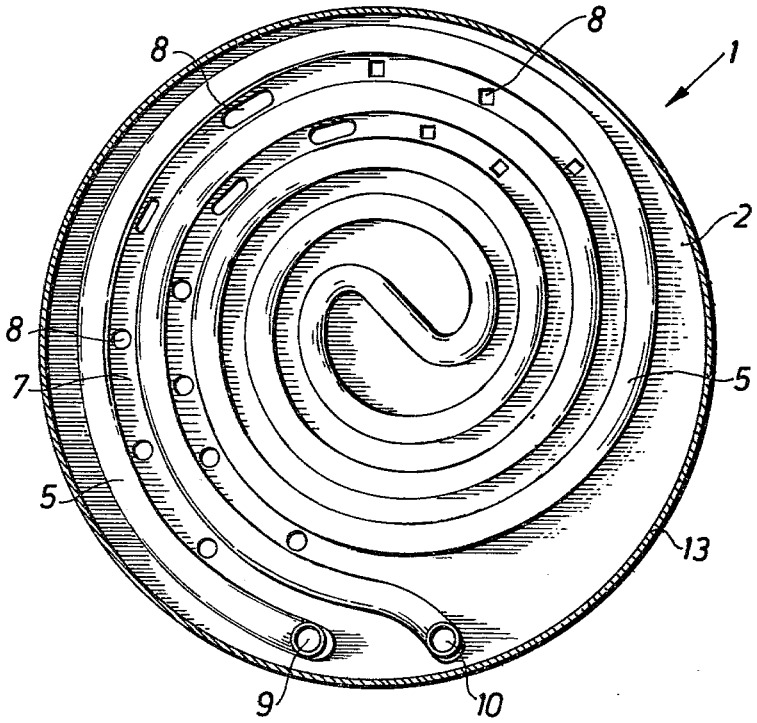
FIG. 2 is a horizontal view of the element shown in FIG. 1.

In FIGS. 1 and 2 reference numeral 1 designates a heat-exchanger element substantially consisting of a circular metal disc 2. A plurality of such elements are generally mounted in a stack or array so that all of the elements are located in mutually parallel planes along a common geometrical centre axis. As has already been mentioned, the one of the two fluids of the apparatus flows in the space between the jacket and the elements, whereas the other fluid passes inside the elements. The corresponding passages formed in the elements may all be interconnected. Alternatively, the elements may be divided into two or more groups so that all elements in each group are interconnected. Each such group or unit is provided with separate inlets and outlets for the fluid passing inside the elements.

Each of the discs 2 consists of two sheets 3 and 4, which in the embodiments shown in FIGS. 1, 2 and 5 are of circular contour, whereas in FIGS. 4 and 6 they are substantially rectangular. As was mentioned above, the metal sheets have by a pressing operation or the like been provided with bulges 5 of substantially semi-circular cross-section. The bulges 5 of the two sheets 3 and 4 making up an element are located opposite each other thus forming a tubular flow channel 6. Reference numerals 9 and 10 designate the inlet and outlet ends of that channel or tube. As appears from the drawing, those inlets and outlets are located adjacent the outer edge of the element. Channel 6 does, generally, follow an irregular path. In FIGS. 1 and 2 the channel forms a double helix, whereas in FIGS. 4, 5 and 6 it is generally meander-shaped.

The flat portions 7 of the two sheets 3 and 4 located between the branches of channel 6 are interconnected, preferably by seam-welding. In this way the interior of channel 6 is sealed off from the interface between the sheets. Preferably, such a weld-seam is located close to channel 6 at both sides thereof. In this way one does not only prevent portions of channel 6 from being short-circuited. A more important result is—see FIG. 3—that it has become possible to break through the flange portions between channels, or tubes, 6 thereby forming apertures 8. This in turn makes it possible for the external fluid to flow generally perpendicularly to the planes of the elements rather than in a zig-zag pattern between the elements. One advantage of the first-mentioned flow pattern is that jacket 13 of the heat-exchanger can, with close tolerances, surround the element array. In this way the heat-exchanger becomes more compact and the flow of the outer fluid can easier be controlled, in the first place by variation of the size and/or number of apertures 8.

In illustration of the last-mentioned advantage FIG. 2 shows such apertures 8 of different shapes. FIG. 2 does also show how jacket 13 surrounds the elements with a tight fit. It should also be noticed that apertures 8 may be formed by a stamping or cutting process which means that the manufacturing costs are lowered. A further advantage of the invention is that it permits a high degree of standardization. More particularly, elements of a given size and channel layout may, within rather wide limits, be used in heat-exchangers which differ from each other in terms of capacity and other significant data, simply by variation of the number, size, and location of the apertures 8. A particular advantage is that one can conveniently increase the effective total area of the apertures even after the heat-exchanger has been put into operation, should this prove desirable or necessary.

According to the embodiment illustrated in FIG. 3 inlet and outlet connections 9 and 10 of each element comprise collars 11 received in corresponding orifices in the walls of channel 6 in an adjacent element. In this way the elements become interconnected by trunk tubes or risers 12. Their location inside the contour of the elements means that the elements can be centrally arranged within jacket 13 and have their outer edges close to the inner wall of the jacket as was mentioned before.

In the embodiment shown in FIG. 4 the elements are of generally rectangular shape. However, at each of the four corners there are recesses 14 the area of which corresponds to the outer cross-section of risers 12*a*, 12*b*, 12*c*, and 12*d*. Thanks to recesses 14 risers 12 are accordingly also in this case located completely inside the envelope of the elements. Every second element has the two ends of its channel 6 connected to two adjacent ones of the risers, e.g. 12*a* and 12*b*, whereas the remaining elements are connected to the two other risers, e.g. 12*c* and 12*d*. Each element is permanently connected only to those two risers with which its channel 6 communicates or, stated in other words, they are by those risers supported in a cantilever fashion. Thanks to this arrangement the manufacture of the heat-exchanger is greatly facilitated as is demounting thereof for repair, inspection, or cleaning. As is directly understood, the corresponding advantage results from the fact that, following removal of the jacket from the element package, the two halves of the package can be separated from each other. For the purpose of increasing the mechanical stability of the element package suitable spacers (not shown) may form supports between the individual elements.

The configuration of channel 6 shown in FIG. 5 is especially advantageous when the elements are traversed by thick pipes or tubes 15.

In FIGS. 6–8 apertures 8 have been formed by a stamping and bending operation. The stamping has created flaps 16 which have been bent outwards from the plane of symmetry of the element. All flaps can be bent away in the same direction. It is, however, more suitable to bend them alternately in opposite directions as shown in FIGS. 7 and 8.

The difference between FIG. 7 and FIG. 8 is that, in FIG. 7, the dimension of apertures 8 at right angles to tubes 6 is greater than the total length of two opposite flaps before the bending thereof. Stated in other words, an intermediate portion of the sheet metal has been removed in connection with the punching operation.

The main advantages of the flaps are the following ones. First, the effective flow passage of the fluid flowing through apertures 8 is increased. Second, the repeated reversal of the direction of flow of that fluid will create turbulence. Both of those factors yield an improved heat transfer between the two fluids. Third, the flaps may also serve as spacers or mechanical supports in the way that channels 6 of one element rest against the edges of flaps 16 of an adjacent element as shown in FIG. 7.

What I claim is:

1. In a heat exchanger comprising an array of at least two plate-like heat exchange elements positioned adjacent one another, each of said plate-like heat exchange elements including at least one passageway defined by a bulge in a portion of the wall of said plate-like heat exchange element, coupling means extending between and integrally attached to adjacently disposed plate-like heat exchange elements for providing a transverse flow conduit connecting a first passageway in a first of said plate-like heat exchange elements with a second passageway in a second of said plate-like heat exchange elements, and flow means for providing a flow passage through said array of plate-like heat exchange elements, the improvement which comprises:

said array of plate-like heat exchange elements each including a plurality of apertures extending transversely through wall portions thereof, with said apertures in said first plate-like heat exchange element axially offset from a further plurality of apertures formed in said adjacently disposed second plate-like heat exchange element, said array of plate-like heat exchange elements each further including a separate pair of parallel flap means extending outwardly in opposite directions from opposite sides of each aperture, with each of said flap means on said first plate-like heat exchange element forming a substantially perpendicular angle with each of said flap means on said second plate-like heat exchange element; and means for substantially reversing the direction of fluid while flowing through said array, thereby creating turbulence and significantly improving the heat transfer within said heat exchanger between said fluid and a further fluid flowing through said passageways in said elements.

2. A heat exchanger according to claim 1, wherein said means for substantially reversing the direction of fluid flow comprises said flap means themselves.

3. A heat exchanger according to claim 1, wherein said coupling means forms an integral part of each of said plate-like heat exchange elements and connects the first passageway in the first of said plate-like heat exchange elements with the second passageway in the second of said plate-like heat exchange elements.

4. A heat exchanger according to claim 1, wherein said array of plate-like heat exchange elements comprises a plurality of plate-like heat exchange elements vertically stacked one on top of the other.

5. A heat exchanger according to claim 1, wherein said coupling means are located inside the contours of the heat exchange elements, and said elements are closely surrounded by a heat exchanger jacket.

6. A heat exchanger according to claim 1, wherein each of said heat exchange elements includes a pair of sheet metal members positioned adjacent to one another.

7. A heat exchanger according to claim 6, wherein said bulge comprises deformed portions in both of said sheet metal members, said deformed portions alignable with one another to form said passageways extending through said respective elements, both of said sheet metal members further including aligned, substantially flat portions interconnected to one another, with said apertures extending transversely through pairs of said flat portions.

8. A heat exchanger according to claim 1, wherein said coupling means further comprises at least one collar formed integrally with said first heat exchange element at one end of said first passageway, and a sleeve formed integrally with said second heat exchange element at one end of said second passageway, said collar and said sleeve engaging one another to form a trunk for circulating fluid between adjacently disposed passageways.

9. A heat exchanger according to claim 1, wherein said flap means comprises a plurality of flaps extending from each plate-like heat exchanger element, with separate flaps positioned on opposite sides of a plurality of said apertures extending through each plate-like element, wherein a plurality of flaps extending from said first plate-like heat exchange element form substantially perpendicular angles with a plurality of flaps extending from said second plate-like heat exchange element.

10. A heat exchanger according to claim 9, wherein said plurality of adjacently disposed plate-like heat exchange elements are vertically stacked one on top of the other, with flaps extending from each of a plurality of said plate-like heat exchange elements contacting and supporting adjacently disposed plate-like heat exchange elements positioned vertically thereabove.

11. A heat exchanger according to claim 9, wherein a plurality of the apertures formed through each of said plate-like heat exchange elements each provides an opening having a length greater than the sum of the lengths of a pair of flaps located on opposite sides of said respective apertures.

12. A heat exchanger according to claim 9, wherein first and second flaps located on opposite sides of at least one aperture extend in substantially opposite directions to one another, with each of said first and second flaps forming an acute angle with a surface portion of the attached plate-like heat exchange element.

* * * * *